United States Patent [19]

Kling et al.

[11] 3,954,401

[45] May 4, 1976

[54] AGENT FOR THE TREATMENT OF CELLULOSIC FIBER MATERIALS AND PROCESS

[75] Inventors: Alfred Kling, Ladenburg; Viktor Specht, Dossenheim, both of Germany

[73] Assignee: Benckiser-Knapsack GmbH, Ladenburg (Neckar), Germany

[22] Filed: Dec. 5, 1973

[21] Appl. No.: 421,805

Related U.S. Application Data

[62] Division of Ser. No. 123,903, March 12, 1971, Pat. No. 3,833,517.

[30] Foreign Application Priority Data

Mar. 14, 1970 Germany ..... 2012171

[52] U.S. Cl. ..... 8/127; 8/133; 8/138; 252/545; 252/546

[51] Int. Cl.[2] ..... D06M 1/02

[58] Field of Search ..... 252/545, 526, 546; 8/127, 133, 138

[56] References Cited

UNITED STATES PATENTS

| | | | |
|---|---|---|---|
| 2,488,832 | 11/1949 | Rossi | 252/105 |
| 3,574,524 | 4/1971 | Hirshfeld | 8/137 |
| 3,586,633 | 6/1971 | Schlussler | 252/137 |
| 3,617,207 | 11/1971 | Benson et al. | 8/127 |

FOREIGN PATENTS OR APPLICATIONS

| | | | |
|---|---|---|---|
| 259,733 | 1/1968 | Austria | 252/545 |
| 1,051,589 | 9/1963 | United Kingdom | 252/545 |

*Primary Examiner*—Carman J. Seccuro
*Attorney, Agent, or Firm*—Erich M. H. Radde

[57] ABSTRACT

Alkaline baths for treating fiber material composed of or containing native cellulose such as cotton do not cause appreciable degradation of the cellulose chain when having added thereto amino alkylene phosphonic acids and/or 1-hydroxy alkane-1,1-diphosphonic acids or their salts.

17 Claims, No Drawings

AGENT FOR THE TREATMENT OF CELLULOSIC FIBER MATERIALS AND PROCESS

This is a division of application Ser. No. 123,903, filed Mar. 12, 1971, now U.S. Pat. No. 3,833,517.

BACKGROUND OF THE INVENTION

1. Field of the Invention

The present invention relates to an agent for subjecting fiber material of native cellulose to a pretreatment in alkaline treatment baths and to a process of treating such fiber material as well as to the thus treated fiber material.

2. Description of the Prior Art

Before bleaching, dyeing, printing fibers of native cellulose and fabrics made therefrom, such fibers and especially cotton are usually freed of their natural fatty, collenchymatous, pectin, and lignin substances, the residues of the seed coats, and the usually oily contaminations due to the spinning and weaving process. Such accompanying substances interfere with the above mentioned finishing processes.

Heretofore, such contaminations and impurities were eliminated by a treatment with alkaline agents such as with sodium carbonate and/or sodium hydroxide solutions whereby the fiber material was either boiled in open vessels or was scoured in closed vessels under pressure and at a temperature up to 135°C. The fiber material was treated for a period of time varying between a few minutes up to 5 or even 8 hours depending upon the type of the starting material and the process employed.

Usually suitable auxiliary agents or adjuvants such as alkali metal polyphosphates and/or wetting agents were added to such alkaline baths.

German Auslegeschrift No. 1,273,481 discloses a process of bleaching fiber material of native cellulose in the absence of oxidizing agents in which 4% to 13%, by weight, of sodium hydroxide and 1% to 4%, by weight, of alkali metal polyphosphates and/or amino polycarboxylic acids such as N-hydroxy ethylene diamino triacetic acid, o-cyclohexylene diamino tetraacetic acid, nitrilo triacetic acid, and ethylene diamino tetraacetic acid were added to the bleaching bath. However, these known methods of pretreating and finishing fiber material composed of native cellulose have many disadvantages. The most important disadvantage of these methods is that they affect and damage the fiber.

SUMMARY OF THE INVENTION

It is one object of the present invention to provide a process of pretreating fiber material of native cellulose in alkaline pretreatment baths which method is free of the disadvantages of the prior art methods and does not cause any substantial damage to the fiber.

Another object of the present invention is to provide a pretreatment and finishing agent for carrying out said method of pretreating and finishing fiber material of native cellulose in alkaline treatment and finishing baths.

Still another object of the present invention is to provide a bucking or soaking preparation useful in the bucking or boiling of fiber material of native cellulose.

A further object of the present invention is to provide pretreated or finished fiber material composed of or containing native cellulose fibers.

Other objects of the present invention and advantageous features thereof will become apparent as the description proceeds.

In principle the process according to the present invention comprises the addition of I. an amino alkylene phosphonic acid of Formula I or its salts and especially its alkali metal salts to the boiling, bucking, and the like baths

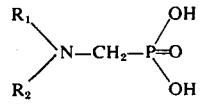

I.

In said formula $R_1$ and $R_2$ indicate the following groups and atoms:

a. $R_1$ and $R_2$ indicate groups of the Formula

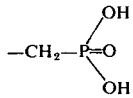

; or b. $R_1$ indicates the group of the Formula

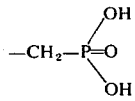

and $R_2$ indicates a group of the Formula

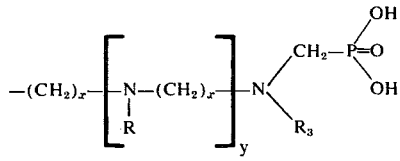

wherein $x$ indicates the numerals 2 and 3;

$y$ indicates the numerals 0 to 4; while R and $R_3$ both are the group of the Formula

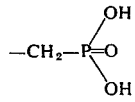

or one of R and $R_3$ is the group of the Formula

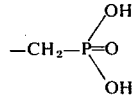

and the other one is hydrogen or both R and $R_3$ indicate hydrogen; or c. $R_1$ indicates the group of the Formula

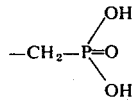

and $R_2$ indicates the group of the Formula

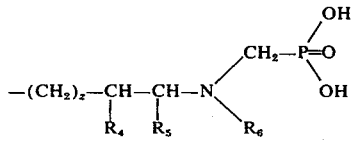

wherein $R_4$ indicates hydrogen and $R_5$ indicates alkyl especially lower alkyl, such as methyl or ethyl; or $R_4$ and $R_5$ together form alkylene, while $z$ indicates the numerals 0 and 1, and $R_6$ indicates hydrogen or the group

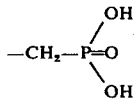

Such amino alkylene phosphonic acids to be added to the bucking, boiling, and other finishing baths are, for instance, amino tris-(methylene phosphonic acid);

diethylene triamino penta-(methylene phosphonic acid);

1,2- and 1,3-propylene diamino tetra-(methylene phosphonic acid);

ethylene diamino tetra-(methylene phosphonic acid);

1,2-cyclohexane diamino tetra-(methylene phosphonic acid);

1-amino methyl cyclopentylamino-(2)-tetra-(methylene phosphonic acid);

dipropylene triamino penta-(methylene phosphonic acid);

1,3-diamino-2-propylene tetra-(methylene phosphonic acid)

and the like compounds.

II. As nitrogen-free compounds there have proved to be useful for the purpose of the present invention 1-hydroxy alkane-1,1-diphosphonic acids.

Alkali metal salts and derivatives of said phosphonic acid compounds can, of course, also be used.

Best results are achieved when adding such alkylene phosphonic acid compounds to the finishing bath in an amount between about 0.3 g./l. to about 5 g./l., preferably in an amount of about 2 g./l.

Furthermore, it has been found that mixtures of said phosphonic acid compounds with other organic and/or inorganic complexing or sequestering compounds such as amino polycarboxylic acids, for instance, ethylene diamino tetraacetic acid, nitrilo triacetic acid, gluconic acid, citric acid, and others can also advantageously be used for the present purpose. An especially advantageous agent is the mixture of the above-mentioned phosphonic acids with alkali metal polyphosphates. When using the alkali metal polyphosphates alone in such alkaline finishing baths, the disadvantage is encountered that the alkali metal polyphosphates are hydrolyzed in the alkaline bath at a bath temperature between 90°C. and 140°C. so that they at least partly lose their power of forming complex compounds with interfering cations such as calcium, magnesium, and the like ions which are usually present in the fiber material to be treated. Such loss of complexing or sequestering power does not take place when amino alkylene phosphonic acid compounds are present in the bath.

On the other hand, the effectiveness of the amino alkylene phosphonic acids is considerably enhanced by the presence of alkali metal polyphosphates of the Formula II $$Me_{n+2}P_nO_{3n+1} \qquad \text{II}$$

wherein

Me indicates an alkali and $n$ may be a numeral between 2 and infinite, preferably between 2 and 24. Such alkali metal polyphosphates are, for instance, sodium pyrophosphate, sodium tripolyphosphate, sodium tetrapolyphosphate, Graham salt, and other soluble polyphosphates of various chain lengths.

By such a combination the dispersive and emulsifying power, and especially the ability of removing and carrying along dirt from the fiber material, i.e. the dirt-solving power, are greatly enhanced. It is understood that many variations in the proportion of phosphonic acid and other complexing or sequestering agents are possible. Best results are achieved, however, with a proportion of the phosphonic acid to the other complexing agent which is between 0.25 and d4.0 : 1.

Wetting agents can also be added to the soaking, bucking, and the like finishing baths. For this purpose all conventional wetting agents may be used provided they are effective in alkaline media and are compatible to the phosphonic acid and the complexing or sequestering agents. Anionic as well as nonionogenic wetting agents or mixtures thereof can be used for this purpose. Alkylaryl sulfonates, fatty acid condensation products, protein cleavage products, and the like as well as their salts can be used as anion active agents. Suitable nonionogenic compounds are, for instance, adducts of ethylene oxide to fatty alcohols, fatty acid amides, alkylphenols, and others.

The important advantage achieved by the use of an agent according to the present invention is to be seen in the fact that the pre-treatment and finishing operation is carried out under conditions not substantially affecting the cellulose chain of the raw cotton. The mean degree of polymerization (M.P.) is only slightly reduced by treating the cellulose fiber according to this invention. The degree of whiteness is remarkably high and the ash content is relatively low.

As is known, chemical attacks upon the native cellulose have the effect that the cellulose chain is split up into larger or smaller fragments depending upon the type of the chemical agents used and the intensity of their action upon the cellulose. The M.P.-values of the treated cellulose were determined because they represent practically the only way of numerically indicating the extent of cleavage of the cellulose chain. Such M.P.-values are given in the following examples.

DESCRIPTION OF THE PREFERRED EMBODIMENTS

The following examples illustrate the present invention without, however, being limited thereto.

The starting material for Examples 1 and 2 is a raw cotton material with an M.P.-value of 2,030, a degree of whiteness of 50.3 %, determined by means of the Elrepho apparatus with a filter R 46, and an ash content of 0.37 %. The raw cotton was treated in a bath (water of a degree of hardness of about 17°; ratio of goods to bath 1 : 10) for 3 hours. The bath had the composition as given hereinafter in Examples 1 and 2.

EXAMPLE 1

Comparative treatment with conventional complexing agents. 1 g./l. of ethylene diamino tetraacetic acid;
1 g./l. of sodium pyrophosphate;
2 g./l. of a wetting agent consisting of a mixture of an ethoxylated fatty alcohol, an alkyl aryl sulfonate, and an alkyl sulfonate; and
7.7 g./l. of sodium hydroxide.

The raw cotton treated as described hereinabove in said bath has an M.P.-value of 1,800, its degree of whiteness is 77 %, and its ash content 0.68 %.

EXAMPLE 2

Treatment according to the present invention.
0.7 g./l. of amino tris-(methylene phosphonic acid);
1.3 g./l. of sodium tripolyphosphate;
1.0 g./l. of a wetting agent consisting of a mixture of a phenylsulfonate with an ethoxylated fatty alcohol;
1.0 g./l. of sodium dithionite $Na_2S_2O_4$; and
20 cc./l. of 50 % sodium hydroxide solution.

The raw cotton treated with such a solution has an M.P.-value of 2,030, a degree of whiteness of 75 %, and an ash content of 0.68 %.

As is evident from Examples 1 and 2, the ash content is about the same in both examples, the degree of whiteness is not appreciably different, but the M.P.-value in the comparative Example 1 is reduced by 230 units, while, when proceeding according to the present invention, the M.P.-value of the raw cotton remains the same. These comparative tests thus clearly show that the cellulose chain in raw cotton, when subjected to a pre-treatment according to the present invention, remains substantially unchanged.

The starting material used in the following Examples 3 to 7 was a raw cotton with an M.P.-value of 2,100, a degree of whiteness of 56% (determined with the Elrepho apparatus with filter R 46) and an ash content of 0.40%. The raw cotton was treated in a bath (ratio of good to liquor: 1 : 10) at 100°C. for 2½ hours. The bath had the composition as given in Examples 3 to 7. The examples indicated by (a) were carried out with distilled water while the examples indicated by (b) used water of a degree of hardness of about 17°.

EXAMPLES 3a and 3b 1 g./l. of ethylene diamino tetra-(methylene phosphonic acid);
1 g./l. of sodium dithionite;
1 g./l. of sodium tripolyphosphate;
1 g./l. of a wetting agent consisting of a mixture of a phenyl sulfonate with an ethoxylated fatty alcohol;
20 cc./l. of 50% sodium hydroxide solution. The cotton treated according to Example 3a, i.e. with distilled water, has an M.P.-value of 2,050. Its degree of whiteness is 72%, and its ash content 0.12%. The cotton treated according to Example 3b, i.e. with tap water, has an M.P.-value of 2,000, its degree of whiteness is 76%, and its ash content 0.15%.

EXAMPLES 4a and 4b 0.7 g./l. of 1-hydroxyalkane-1,1-diphosphonic acid;
1.3 g./l. of sodium tripolyphosphate;
1.0 g./l. of sodium dithionite;
1.0 g./l. of a wetting agent consisting of a mixture of a phenyl sulfonate with an ethoxylated fatty alcohol; and
20 cc./l. of a 50% sodium hydroxide solution.

The cotton treated according to Example 4a, i.e. with distilled water, has an M.P.-value of 2,025, a degree of whiteness of 77%, and an ash content of 0.12%. The cotton treated according to Example 4b, i.e. with tap water, has an M.P.-value of 2,000, its degree of whiteness is 75%, and its ash content 0.13%.

Raw cotton with the same properties as described hereinabove was treated according to the following Examples 5 and 6 under high temperature conditions, i.e. at 130°C. for 1 hour, whereby the amount of 50% sodium hydroxide solution was reduced to 10 ml./l. Otherwise, the composition of the treating agents was the same as in Examples 3 and 4. As in said examples, the examples designated by (a) were carried out with distilled water, while the examples designated by (b) used tap water of a degree of hardness of about 17°.

The treatment of the raw cotton with the treating agent according to Example 5(a) resulted in a cotton of an M.P.-value of 1,850, a degree of whiteness of 72%, and an ash content of 0.1%.

The treatment according to Example 5(b) resulted in a cotton of an M.P.-value of 2,000, a degree of whiteness of 71%, and an ash content of 0.25%.

When treating the cotton with the agent as given in Examples 4(a) and 4(b), the treated cotton has the following M.P.-values:

EXAMPLE 6(a)

M.P.-value 1,900;
degree of whiteness 73%;
ash content 0.1%.

EXAMPLE 6(b)

M.P.-value 2,000;
degree of whiteness 71%;
ash content 0.15%.

EXAMPLE 7

The same raw cotton was treated according to the known process with a bath which was considered as yielding optimum results and which contained per liter of distilled water
3.4 g. of ethylene diamino tetraacetic acid;
1.6 g. of sodium dithionite;
1.0 g. of a wetting agent consisting of an alkylene sulfonate, an alkyl aryl sulfonate, and ethoxylated fatty alcohols, and
20 cc. of a 50 % sodium hydroxide solution.

After treating the cotton with said bath at 100°C. for 2½ hours, the M.P.-value of the treated cotton was 1,775, its degree of whiteness 75%, and its ash content 0.15%.

After a treatment at 130°C. for 1 hour, the M.P.-value was 1,750, the degree of whiteness 70%, and the ash content of 0.14%.

The starting material in the following Examples 8 to 10 was a cotton with an M.P.-value of 1,740 and a degree of whiteness of 48.8% (determined with the Elrepho apparatus with filter R 46). The cotton was heated in a bath (ratio of good to liquor: 1 : 10; hardness of the water: about 17°) at 100°C. for 3 hours. The bath composition was as given in Examples 8 to 10.

EXAMPLE 8(a)

7.7 g./l. of sodium hydroxide;
2.0 g./l. of a wetting agent consisting of a phenylsulfonate with an ethoxylated fatty alcohol.

EXAMPLE 8(b)

7.7 g./l. of sodium hydroxide;
2.0 g./l. of the wetting agent of Example 8a; and
1.0 g./l. of sodium dithionite $Na_2S_2O_4$.

EXAMPLE 9(a)

1.0 g./l. of ethylene diamine tetraacetic acid;
1.0 g./l. of sodium pyrophosphate $Na_4P_2O_7$;
2.0 g./l. of the wetting agent of Example 8a; and
7.7 g./l. of sodium hydroxide.

EXAMPLE 9(b)

1.0 g./l. of ethylene diamine tetraacetic acid;
1.0 g./l. of sodium pyrophosphate $Na_4P_2O_7$;
2.0 g./l. of the wetting agent of Example 8a;
7.7 g./l. of sodium hydroxide; and
1.0 g./l. of sodium dithionite $Na_2S_2O_4$.

EXAMPLE 10(a)

2.0 g./l. of ethylene diamine tetra-(methylene phosphonic acid);
2.0 g./l. of the wetting agent of Example 8a; and
7.7 g./l. of sodium hydroxide.

EXAMPLE 10(b)

2.0 g./l. of ethylene diamine tetra-(methylene phosphonic acid);
2.0 g./l. of the wetting agent of Example 8a;
7.7 g./l. of sodium hydroxide; and
1.0 g./l. of sodium dithionite $Na_2S_2O_4$.

The following Table shows the M.P.-values of the treated cotton as well as its degree of whiteness:

Table

| Example No. | M.P. -value | Degree of whiteness |
|---|---|---|
| Starting cotton | 1740 | 48.8 % |
| 8a | 670 | 67.1 % |
| 8b | 1565 | 65.2 % |
| 9a | 1230 | 71.1 % |
| 9b | 1605 | 67.8 % |
| 10a | 1495 | 68.4 % |
| 10b | 1785 | 64.5 % |

These results clearly prove that treatment of cotton with an alkaline bath containing ethylene diamine tetra-(methylene phosphonic acid) according to the present invention considerably improves the M.P.-value of the treated cotton. For instance, while treatment with ethylene diamine tetraacetic acid without sodium dithionite (Example 9a) yields a cotton with an M.P.-value of 1230, the M.P.-value of cotton treated under the same conditions with the amino alkylene phosphonic acid has an M.P.-value of 1495, i.e. an improvement by 265, i.e. a very considerable decrease in the degradation of the cellulose chain.

When treating the cotton in the presence of sodium dithionite, the degradation of the cellulose chain is considerably reduced due to the sodium thionite preventing the oxidizing effect of atmospheric oxygen upon the cotton fiber. Treatment with an amino alkylene phosphonic acid according to the present invention (Example 10b) yields a treated cotton with an even higher M.P.-value than that of the starting cotton, namely with an M.P.-value of 1785 as compared with the initial M.P.-value of 1740. If no complexing agent is present in the treating bath, the M.P.-value is reduced to 1565 (Example 8b), as compared with 1740 of the starting cotton, while, if the complexing agent ethylenediamine tetraacetic acid is added, the M.P.-value of the treated cellulose fiber is increased only slightly, namely to 1605 (Example 9b). That the M.P.-value of cotton treated according to the present invention with the addition of sodium dithionite is even higher than that of the starting cotton is probably due to the fact that no degradation takes place and that the low molecular cellulose components are dissolved and removed during treatment.

The results given in all the preceding Examples 1 to 10 were obtained as mean values calculated each time from four determinations.

These results clearly show that on boiling and bucking experiments carried out by adding relatively small amounts of the phosphonic acids according to the present invention, the degradation of the cellulose chain as demonstrated by the M.P. values is so small that the treatment according to the present invention represents a noteworthy improvement of the heretofore used optimum mode of operation which causes considerable degradation of the cellulose. This improvement is not due solely to the sequestering power of the phosphonic acid added especially since the ash content and the degree of whiteness remain substantially unchanged.

The "Elrepho apparatus with filter R 46" used for determining the degree of whiteness is an electric remission photometer of the firm Carl Zeiss with a band elimination filter having its optimum transmission at 460 nm.

The M.P. value, i.e. the mean degree of polymerization value was determined according to the Cuoxam method as it is described, for instance, by J. J. Riphagen in "Melliand Textilberichte" 1971, pages 133 to 136. These values are also designated as "D.P.-values", i.e. degree of polymerization values.

The 1-hydroxy alkane-1,1-diphosphonic acid used in Examples 4a, 4b, and 6a, 6b was 1-hydroxy ethylene-1,1-diphosphonic acid. 1-Hydroxy propylene-1,1,3-triphosphonic acid has also proved to be effective.

We claim:

1. In a process for treating native cellulose fiber material to remove natural fatty, collenchymatous, pectin and lignin substances as well as residues of seed coats and oily contaminations due to spinning and weaving, comprising treating said fiber material at an elevated temperature of between about 90° and 140°C. with a strongly alkaline aqueous bath containing between about 5 and 10 g./l. of alkali metal hydroxide, the improvement which comprises said alkaline bath containing a phosphonic acid compound selected from the group consisting of an amino alkylene phosphonic acid, a 1-hydroxy lower alkane-1,1-diphosphonic acid alkali metal salts thereof and mixtures thereof.

2. The process as defined by claim 1, wherein said fiber material is cotton.

3. The process as defined by claim 1, wherein said alkaline bath further comprises a water-soluble sequestering agent selected from the group consisting of alkali metal polyphosphates, amino polycarboxylic acids, citric acid, gluconic acid, salts thereof and mixtures thereof.

4. The process as defined by claim 1, wherein said alkaline bath further comprises a wetting agent capable of retaining its wetting power in said alkaline bath and being compatable with said phosphonic acid compound.

5. The process as defined by claim 1, wherein said phosphonic acid compound is present in the alkaline bath in an amount of about 0.3 g./l. and about 5 g./l.

6. The process as defined by claim 5, wherein said alkaline bath further comprises a sequestering agent selected from the group consisting of alkali metal polyphosphates, amino polycarboxylic acids, citric acid, gluconic acid, salts thereof and mixtures thereof in an amount between about 0.25:1 and about 4:1 with respect to said phosphonic acid compound.

7. The process as defined by claim 1, wherein said phosphonic acid compound is amino tris-(methylene phosphonic acid).

8. The process as defined by claim 1, wherein said phosphonic acid compound is ethylene diamino tetra-(methylene phosphonic acid).

9. The process as defined by claim 1, wherein said phosphonic acid compound is a 1-hydroxy alkane-1,1-diphosphonic acid.

10. The process as defined by claim 1, wherein said phosphonic acid compound is selected from the group consisting of amino alkylene phosphonic acids of the formula:

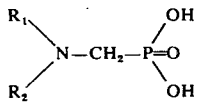

wherein $R_1$ is the group of the formula

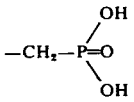

while $R_2$ is a member selected from the group consisting of the group of the formula

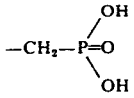

the group of the formula

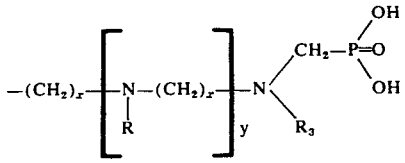

wherein

X is one of the numerals 2 and 3;

y is one of the numerals 0 to 4; while

R and $R_3$ are members selected from the group consisting of hydrogen and the group of the formula

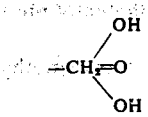

and the group of the formula

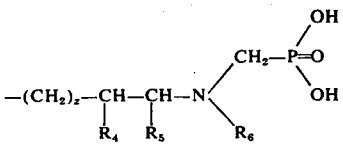

wherein $R_4$ is hydrogen;

$R_5$ is a member selected from the group consisting of lower alkyl and $R_4$ and $R_5$ together form lower alkylene;

$R_6$ is a member selected from the group consisting of hydrogen and the group of the formula

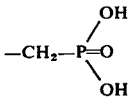

and z is one of the numerals 0 and 1;

and the alkali metal salts thereof.

11. The process as defined by claim 10, wherein said alkaline bath further comprises an alkali metal polyphosphate of the formula:

$$Me_{n+2}\,P_n\,O_{3n+1}$$

wherein

Me is an alkali metal and n is one of the numerals 2 to 24.

12. The process as defined by claim 1, wherein said alkaline bath further comprises sodium dithionite in an amount sufficient to inhibit degradation of the cellulose chain by atmospheric oxygen.

13. The process as defined by claim 12, wherein said sodium dithionite is present in an amount of about 1 g./l.

14. The process as defined by claim 1, wherein said alkaline bath comprises between about 0.3 and 5 g./l. of said phosphonic acid compound, a sequestering compound selected from the group consisting of alkali polyphosphates, amino polycarboxylic acids, citric acid, gluconic acid, their salts, and mixtures thereof, the proportion of phosphonic acid compound to sequestering compound being between about 0.15:1 and about 4.0:1, and sodium dithionite in an amount sufficient to inhibit degradation of the cellulose chain by atmospheric oxygen.

15. The process as defined by claim 10 wherein said phosphonic acid compound is selected from the group consisting of amino tris-(methylene phosphonic acid);

diethylene triamino penta-(methylene phosphonic acid);

1,2- and 1,3-propylene diamino tetra-(methylene phosphonic acid);

ethylene diamino tetra-(methylene phosphonic acid);

1,2-cyclohexane diamino tetra-(methylene phosphonic acid);

1-amino methyl cyclopentylamino-(2)-tetra-(methylene phosphonic acid;

dipropylene triamino penta-(methylene phosphonic acid) and 1,3-diamino-2-propylene tetra-(methylene phosphonic acid).

16. The process as defined in claim 9, wherein said diphosphonic acid comprises 1-hydroxy ethylene-1,1-diphosphonic acid.

17. The process as defined in claim 11, wherein said alkali metal polyphosphate is sodium tripolyphosphate.

* * * * *